US008905524B2

(12) United States Patent
Togashi

(10) Patent No.: US 8,905,524 B2
(45) **Date of Patent: *Dec. 9, 2014**

(54) LIQUID EJECTING HEAD, LIQUID EJECTING HEAD UNIT, AND LIQUID EJECTING APPARATUS

(71) Applicant: Seiko Epson Corporation, Tokyo (JP)

(72) Inventor: Isamu Togashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/166,120

(22) Filed: Jan. 28, 2014

(65) Prior Publication Data

US 2014/0139594 A1 May 22, 2014

Related U.S. Application Data

(63) Continuation of application No. 13/075,129, filed on Mar. 29, 2011, now Pat. No. 8,672,459.

(30) Foreign Application Priority Data

Mar. 30, 2010 (JP) ..... 2010-079887

(51) Int. Cl.
*B41J 2/045* (2006.01)
*B41J 2/14* (2006.01)

(52) U.S. Cl.
CPC ..... *B41J 2/14201* (2013.01); *B41J 2/14274* (2013.01); *B41J 2002/14419* (2013.01)
USPC ..... 347/70; 347/71

(58) Field of Classification Search
CPC ..... B41J 2/14233; B41J 2002/14419; B41J 2/14274; B41J 2/14201; B41J 2002/14258; B41J 2/1612
See application file for complete search history.

(56) References Cited

U.S. PATENT DOCUMENTS 7,070,263 B2 7/2006 Okazawa
7,735,978 B2 6/2010 Chikamoto
(Continued)

FOREIGN PATENT DOCUMENTS

JP 2003-127354 A 5/2003
JP 2005-289074 A 10/2005
(Continued)

OTHER PUBLICATIONS

Examination Report, dated Oct. 9, 2013, of corresponding Japanese Application No. 2010-079887. 2 pages.
(Continued)

*Primary Examiner* — Lisa M Solomon
(74) *Attorney, Agent, or Firm* — Kilpatrick Townsend & Stockton LLP

(57) ABSTRACT

A liquid ejecting head includes nozzles for ejecting liquid; pressure generation chambers, each in fluid communication with one of the nozzles; and a manifold substrate with manifolds disposed therein. Each manifold supplies liquid to at least one of the pressure generation chambers. The liquid ejecting head also includes a head case with a piezoelectric element housing unit. Piezoelectric elements, for changing pressure of liquid within the pressure generation chambers, are provided in the piezoelectric element housing unit. The liquid ejecting head also includes a vibrating element for absorbing pressure changes in the liquid within the manifolds, cavities provided on the vibrating element at positions that correspond to positions of the manifolds, and an atmosphere exposure channel that fluidly connects one of the cavities to the atmosphere. At least one other one of the cavities is in fluid communication with the atmosphere exposure channel via the first cavity.

21 Claims, 7 Drawing Sheets

(56) References Cited

U.S. PATENT DOCUMENTS

| | | | |
|---|---|---|---|
| 2004/0114005 | A1 | 6/2004 | Okazawa et al. |
| 2004/0257391 | A1 | 12/2004 | Hosono |
| 2006/0290725 | A1 | 12/2006 | Akahane |
| 2007/0109373 | A1 | 5/2007 | Kojima |
| 2009/0273619 | A1 | 11/2009 | Akahane |
| 2013/0162719 | A1 | 6/2013 | Akahane |

FOREIGN PATENT DOCUMENTS

| | | | |
|---|---|---|---|
| JP | 2007-001107 | A | 1/2007 |
| JP | 2007-145014 | A | 6/2007 |
| JP | 2009-214500 | A | 9/2009 |
| JP | 2010-194901 | A | 9/2010 |

OTHER PUBLICATIONS

Non-Final Office Action, dated Feb. 15, 2013, of related U.S. Appl. No. 13/075,129.

Notice of Allowance, dated Jul. 24, 2013, of related U.S. Appl. No. 13/075,129.

Notice of Allowance, dated Oct. 28, 2013, of related U.S. Appl. No. 13/075,129.

LIQUID EJECTING HEAD, LIQUID EJECTING HEAD UNIT, AND LIQUID EJECTING APPARATUS

CROSS REFERENCES TO RELATED APPLICATIONS

This application is a continuation of U.S. application Ser. No. 13/075,129 filed Mar. 29, 2011, which claims priority to Japanese Patent Application No. 2010-79887 filed Mar. 30, 2010, the entireties of which are expressly incorporated herein by reference.

BACKGROUND

1. Technical Field

The present invention relates to liquid ejecting heads, liquid ejecting head units, and liquid ejecting apparatuses that eject liquid from nozzles.

2. Related Art

Liquid ejecting heads that eject liquid droplets from a nozzle by applying pressure to the liquid, using a piezoelectric element, have been known for some time. Ink jet recording heads that eject ink droplets from the nozzles are one example.

A typical ink jet recording head includes multiple pressure generation chambers at one surface of a nozzle plate in which multiple nozzles are provided, each of the pressure generation chambers communicating with respective nozzles. An ink chamber or manifold provides the ink to the pressure generation chambers. A piezoelectric element forces ink out of the nozzles by causing the pressure within the pressure generation chambers to change. A cavity faces each manifold to absorb pressure fluctuations in the liquid within the common manifold. An example of such a recording head is disclosed in Japanese Patent Publication 2005-289074, published on Oct. 20, 2005, the contents of which are hereby incorporated by reference.

The cavity is open to the air to keep the pressure within it constant. There are thus situations where the water content within the ink evaporates from the cavity and causes a rise in the viscosity of the ink, which leads to ejection problems. Accordingly, excessive evaporation is prevented by a control channel offering channel resistance that prevents evaporation.

However, with the demand for an increase in the viscosity of inks, the maintenance of favorable ink ejection properties over a long period of time, and so on, there is now more than ever a further demand to prevent evaporation.

This problem exists not only for ink jet recording heads, but for any liquid ejecting head that ejects a liquid.

SUMMARY

An advantage of some aspects of the invention is to provide a liquid ejecting head, a liquid ejecting head unit, and a liquid ejecting apparatus capable of maintaining favorable ejection properties over time.

A liquid ejecting head includes nozzles for ejecting liquid; pressure generation chambers, each in fluid communication with one of the nozzles; and a manifold substrate with manifolds disposed therein. Each manifold supplies liquid to at least one of the pressure generation chambers. The liquid ejecting head also includes a head case with a piezoelectric element housing unit. Piezoelectric elements, for changing pressure of liquid within the pressure generation chambers, are provided in the piezoelectric element housing unit. The liquid ejecting head also includes a vibrating element for absorbing pressure changes in the liquid within the manifolds, cavities provided on the vibrating element at positions that correspond to positions of the manifolds, and an atmosphere exposure channel that fluidly connects one of the cavities to the atmosphere. At least one other one of the cavities is in fluid communication with the atmosphere exposure channel via the first cavity.

A liquid ejecting apparatus according to another aspect of the invention includes the aforementioned liquid ejecting head or liquid ejecting head unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
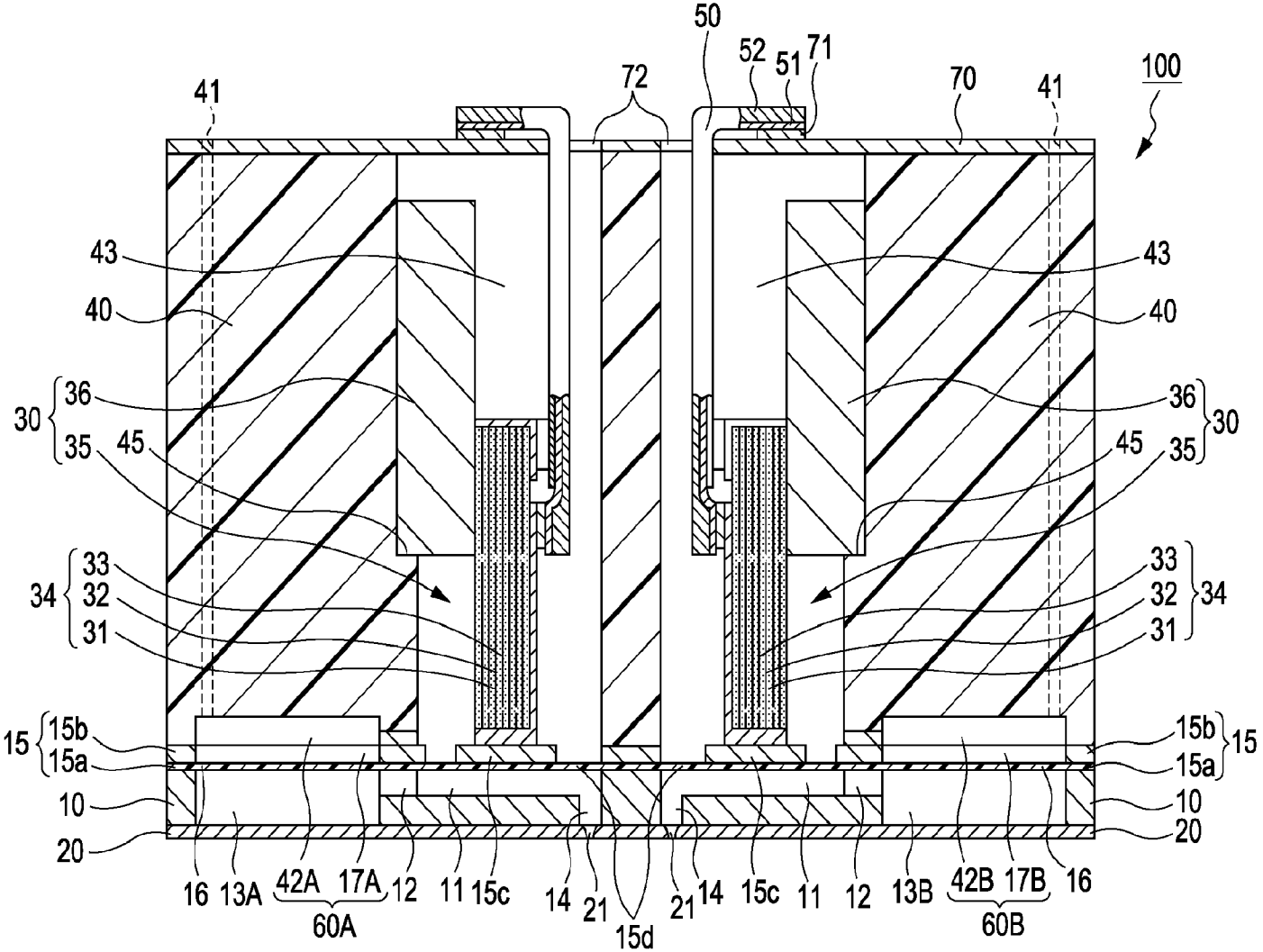
FIG. 1 is a cross-sectional view of an ink jet recording head according to an exemplary embodiment of the invention.

Hereinafter, an embodiment of the invention will be described in detail with reference to the drawings. FIG. 1 is a cross-sectional view of an ink jet recording head.

As illustrated in FIGS. 1 through 3B, an ink jet recording head (called simply a "recording head" hereinafter) 100 according to this embodiment includes: a flow channel substrate 10 having pressure generation chambers 11; a nozzle plate 20 in which multiple nozzles 21 that communicate with respective pressure generation chambers 11 are provided; and a vibrating member or sealing plate, 15 affixed to the surface of the flow channel substrate 10 opposite the nozzle plate 20. Furthermore, the recording head 100 according to this embodiment includes a piezoelectric element unit 30 having multiple piezoelectric elements 35 provided in regions corresponding to respective pressure generation chambers 11 on the vibrating member 15, and a case 40 affixed to one surface of the flow channel substrate 10 sandwiching the vibrating member 15 therebetween. A manifold 13, which serves as a liquid supply chamber for the pressure generation chambers 11 is provided in the flow channel substrate 10, and thus the flow channel substrate 10 also serves as a manifold substrate.

Multiple pressure generation chambers 11 are provided in the flow channel substrate 10 in the width direction (perpendicular to the page in FIG. 1), and are divided up by partitions. Note that in the embodiment illustrated in FIG. 1, two rows of pressure generation chambers 11 are provided. In addition, the manifold 13, through which ink is supplied via an ink introduction channel 41 of the case 40, is provided on the outside of each row of pressure generation chambers 11, passing through the flow channel substrate 10 in the thickness direction. In other words, a single manifold 13 extends along and feeds the whole row of pressure generation chambers 11.

The manifold 13 and the pressure generation chambers 11 fluidly communicate with each other via an ink supply channel 12, and ink is supplied to the pressure generation chambers 11 via the ink introduction channel 41, the manifold 13, and the ink supply channel 12. The ink supply channel 12 may be narrower than the pressure generation chambers 11, and thus maintains the flow channel resistance for the ink flowing from the manifold 13 into the pressure generation chambers 11 at a constant resistance.

Furthermore, nozzle communication holes 14 are provided to the pressure generation chambers 11 on the side opposite the manifold 13. In other words, the manifolds 13, the ink supply channels 12, the pressure generation chambers 11, and the nozzle communication holes 14 are provided in the flow channel substrate 10 as a liquid flow channel. The flow channel substrate 10 may be made, for example, of a silicon single-crystal substrate, and the stated pressure generation chambers 11, manifolds 13, and so on provided in the flow channel substrate 10 may be formed by etching the flow channel substrate 10.

The nozzle plate 20, in which multiple nozzles 21 that eject ink are provided, is affixed to one surface of the flow channel substrate 10, and each of the nozzles 21 fluidly communicates with a respective pressure generation chamber 11 via the nozzle communication hole 14 provided in the flow channel substrate 10.

Further, the vibrating member 15 is affixed to the other surface of the flow channel substrate 10 to seal the pressure generation chambers 11. Note that as shown in the drawings, the vibrating member 15 has approximately the same surface area as the flow channel substrate 10, and covers the entire surface of the flow channel substrate 10.

In the embodiment shown in FIG. 1, the vibrating member 15 is a compound plate, including an elastic membrane 15*a*, composed of an elastic member, such as a resin film or the like, and a support plate 15*b*, which supports the elastic membrane 15*a*, and is formed of, for example, metal. The elastic membrane 15*a* is affixed to the flow channel substrate 10. The elastic membrane 15*a* may be made, for example, of polyphenylene sulfide (PPS) film that is approximately several μm thick, whereas the support plate 15*b* may be made of a stainless steel plate (SUS) that is approximately several tens of μm thick.

In addition, the regions of the vibrating member 15 that oppose the surrounding edges of the pressure generation chambers 11 have had the support plate 15*b* removed therefrom, resulting in thin film portions 15*d* essentially made only of the elastic membrane 15*a*. These thin film portions 15*d* define one surface of the pressure generation chambers 11. In addition, islands 15*c*, constructed of a part of the support plate 15*b*, with which the tips of the piezoelectric elements 35 make contact, are provided on the inner sides of the thin film portions 15*d*.

In addition, the regions of the vibrating member 15 that oppose the manifolds 13 have also had the support plate 15*b* removed therefrom, resulting in vibrating members 16 made only of the elastic membrane 15*a*, and defining first cavity portions 17. The vibrating member 16 absorbs pressure fluctuations within the manifold 13, thus maintaining the pressure within the manifold 13 at a constant pressure.

The case 40 is attached to the vibrating member 15. In other words, the case 40 according to this embodiment is affixed to the flow channel substrate 10 with the vibrating member 15 therebetween. As shown in FIG. 1, a second cavity portion 42 is provided in the case 40 in a region opposing the first cavity portion 17, and the second cavity portion 42 is of a height that will not interfere with the deformation of the vibrating member 16. In this manner, a cavity 60 includes the first cavity portion 17 and the second cavity portion 42. Although details will be given later, the cavity 60 is exposed to the atmosphere through an opening provided in the upper surface of the case 40. As a result, the pressure within the cavity 60 (the first cavity portion 17 and the second cavity portion 42) is kept at atmospheric pressure. Further, steps 45 are provided in piezoelectric element housing units 43 on the sides thereof that face the ink introduction channels 41, and anchor plates 36 for the piezoelectric element units 30, described later, are affixed to respective steps 45.

In addition, a wiring board 70 is attached to the surface of the case 40 opposite the flow channel substrate 10. Multiple conductive pads 71 are provided in the wiring board 70, and are connected to respective wiring layers 51 of a flexible printed circuit board 50, which will be described later. Slit-shaped openings 72 are provided in regions of the wiring board 70 that oppose the piezoelectric element housing units 43 in the case 40, and the piezoelectric element housing units 43 communicate with the atmosphere through the openings 72. The piezoelectric element units 30 are housed in the respective piezoelectric element housing units 43.

The piezoelectric element units 30 are provided opposite to respective pressure generation chambers 11, and each is made of multiple piezoelectric elements 35 that cause the pressure within the liquid flow channel, including the pressure generation chamber 11 and the manifold 13, to fluctuate, and the anchor plate 36 that affixes the piezoelectric elements 35 to the case 40.

The piezoelectric element units 30 may be constructed as follows. First, a piezoelectric element formation member 34 is created by layering a piezoelectric material 31 and electrode formation materials 32 and 33, in sandwich form and in an alternating manner, and then cutting up the piezoelectric element formation member 34 into a comb-tooth shape so that each piezoelectric element 35 corresponds to one of the pressure generation chambers 11. In other words, in this embodiment, multiple piezoelectric elements 35 are formed in an integral manner. The tips of the piezoelectric elements 35 are affixed to respective islands 15*c* of the vibrating members 15 using an adhesive, and the bases of the piezoelectric elements 35, which are inactive regions that do not contribute to vibration, are anchored to the anchor plates 36. The anchor plates 36 are affixed to the case 40 using the steps 45 of the piezoelectric element housing units 43 to anchor the piezoelectric element units 30 in the piezoelectric element housing units 43 of the case 40.

Thus, the piezoelectric element unit 30 is provided with the anchor plate 36 integrally connected to a respective piezoelectric element 35, and is then positioned relative to and anchored to the case 40. The positioning of the piezoelectric element 35 relative to the island 15*c* is carried out using the outer circumferential surface of the anchor plate 36 and the inner surface of the piezoelectric element housing unit 43 of the case 40. It is therefore possible to position the piezoelectric element 35, which is a brittle material, easier and with higher precision than when positioning the piezoelectric element 35 by grasping the piezoelectric element 35 directly.

The anchor plate 36 can be made using, for example, aluminum, copper, iron, stainless steel, or the like. The flexible printed circuit board 50, which has the wiring layers 51 that supply signals for driving the piezoelectric elements 35, is connected near the base portion of the piezoelectric element 35, opposite the anchor plate 36.

The flexible printed circuit board 50 may be made of a flexible printing circuit (FPC), a tape carrier package (TCP), or the like. The wiring layers 51 may be made of a copper thin film or the like in a specific pattern on the surface of a base film 52, which may be polyimide or the like. Regions other than those in which the wires connect to other wires, such as a terminal portion that connects the wiring layer 51 to the piezoelectric element 35, may be covered with an insulating material.

The wiring layer 51 of the flexible printed circuit board 50 is connected at its base end to the electrode formation materials 32 and 33 of the piezoelectric element 35, using, for example, solder, an anisotropic conductor, or the like.

Meanwhile, the tip of each of the wiring layers 51 is electrically connected to a respective conductive pad 71 on the wiring board 70. The portion of the flexible printed circuit board 50 that extends outside of the piezoelectric element housing unit 43 is bent 90° and connected to the conductive pad 71.

With this recording head 100, the volumes of the pressure generation chambers 11 are adjusted by the deformation of the piezoelectric elements 35 and the vibrating members 15, which in turn causes ink droplets to be ejected from the nozzles 21. Specifically, ink is supplied to the manifolds 13 from a liquid holding unit (not shown) via the ink introduction channels 41, and is then distributed to the pressure generation chambers 11 via the ink supply channels 12. Then, the piezoelectric elements 35 constrict and extend by a voltage being applied to and released from them as a result of a driving signal from a driving circuit (not shown); this causes a pressure change in the pressure generation chambers 11, which in turn causes ink to be ejected from the nozzles 21.

Figure 2:
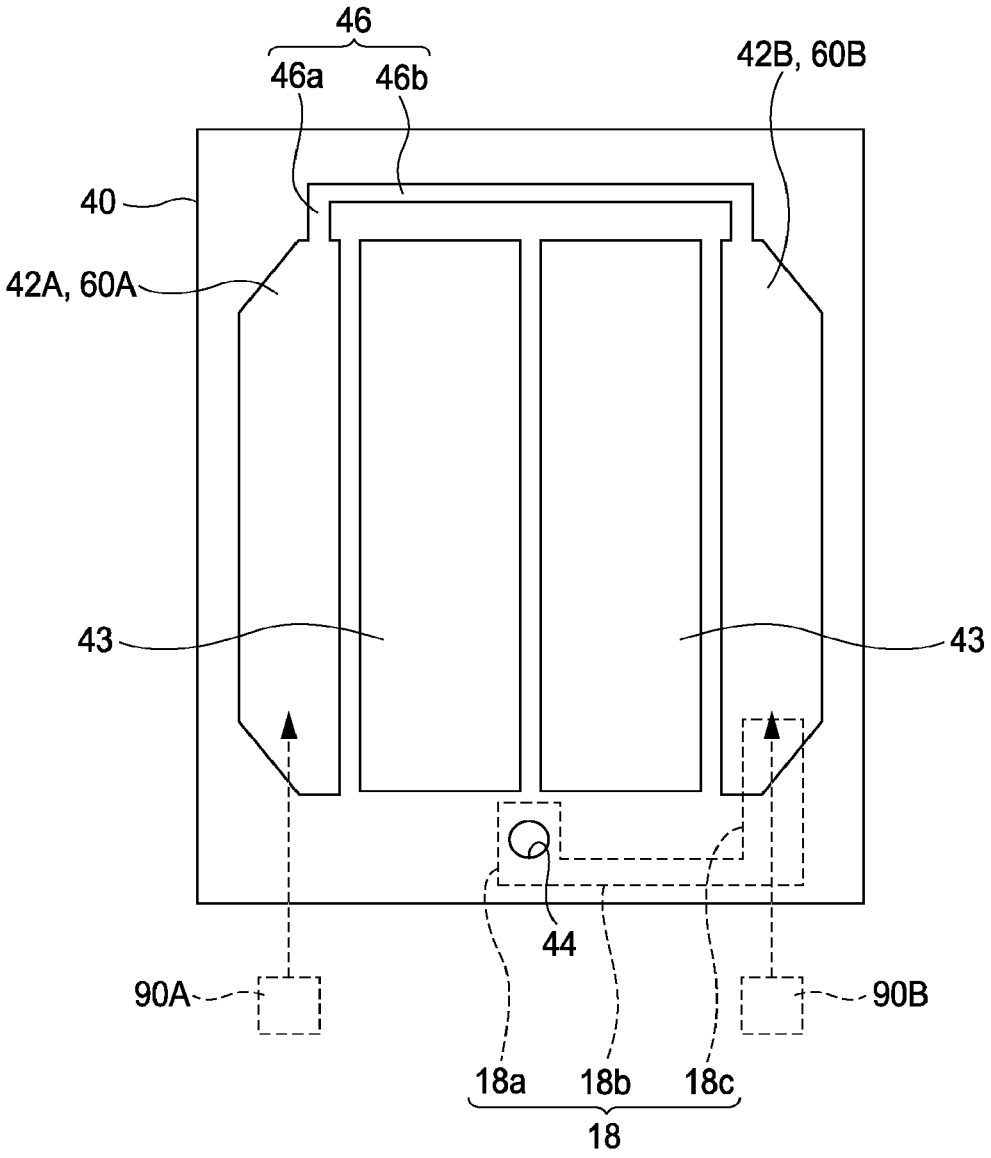
FIG. 2 is a bottom view of an ink jet recording head case according to a first exemplary embodiment of the invention.
Figure 3A:
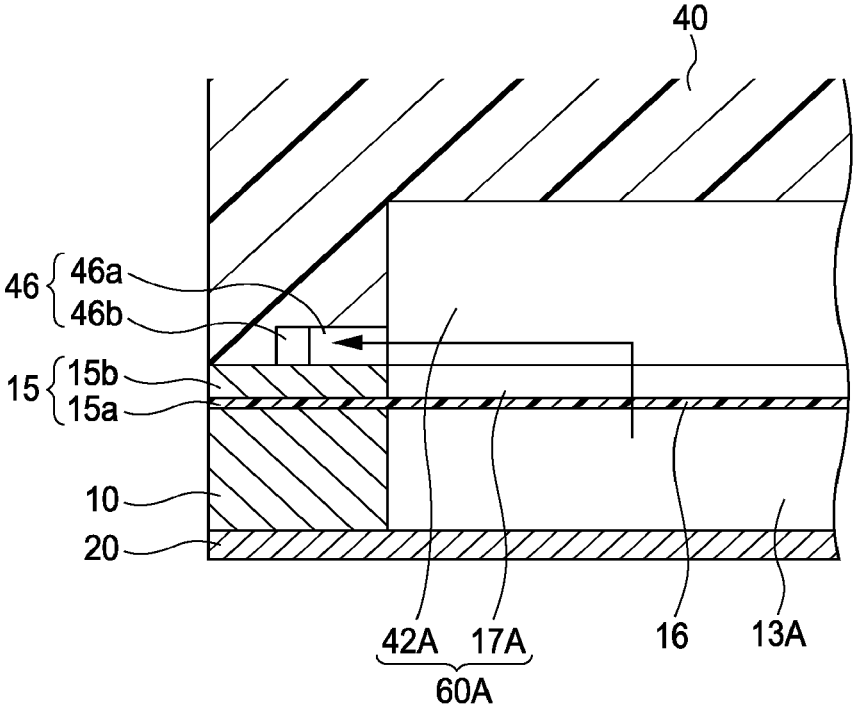
FIGS. 3A and 3B are cross-sectional views illustrating enlarged portions of an ink jet recording head according to an exemplary embodiment of the invention. The cross-section is taken perpendicular to that of FIG. 1.
Figure 3B:
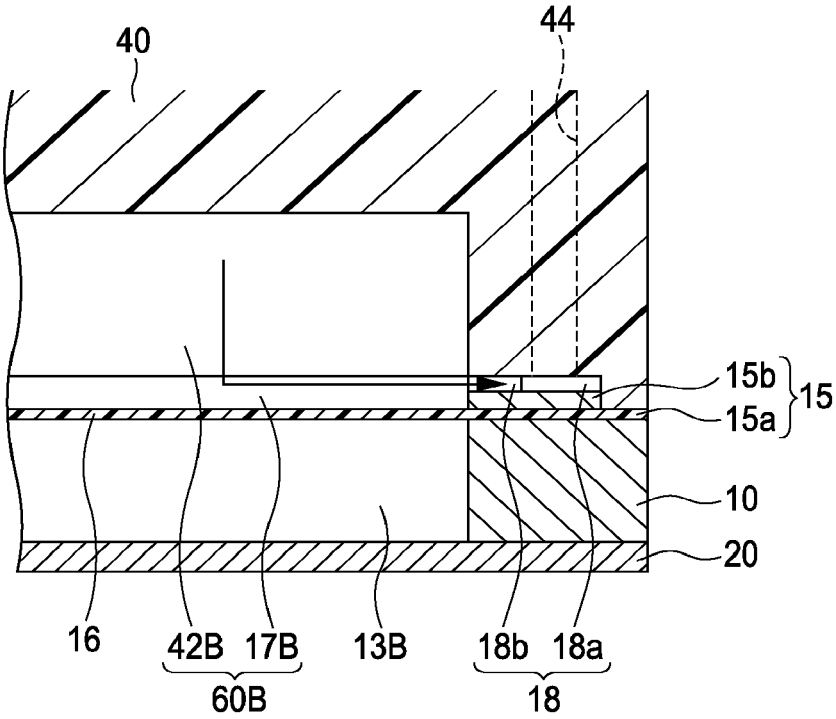

The recording head 100 of FIG. 1 is provided with cavities 60A and 60B in regions that correspond to manifolds 13A and 13B, respectively. Next, the cavities 60A and 60B, and the communication state thereof with an atmosphere exposure channel 44 that fluidly communicates with the atmosphere, will be described using FIGS. 2 to 3B. FIG. 2 is a bottom view of a head case, whereas FIGS. 3A and 3B are cross-sectional views illustrating enlarged portions of some of the elements of FIG. 1. The cross-section of FIGS. 3A and 3B is taken perpendicular to the page of FIG. 1.

As shown in FIGS. 1 and 2, second cavity portions 42A and 42B are provided in regions corresponding to the manifolds 13A and 13B in the head case 40. The second cavity portion 42A fluidly communicates with the second cavity portion 42B via a cavity portion communication channel 46.

The cavity portion communication channel 46 is a channel defined in the base of the case 40.

The cavity portion communication channel 46 according to the embodiment of FIG. 2 is provided in a position that does not overlap with the flow channel 11, 12, 14 in the vertical direction of FIG. 1. Specifically, the cavity portion communication channel 46 is provided further into or out of the page in FIG. 1 than the flow channels 11, 12, 14.

The cavity portion communication channel 46 includes a first cavity portion communication channel 46*a* that connects to the second cavity portions 42 and extends from the ends of the second cavity portions 42 vertically in FIG. 2, and perpendicular to the page in FIG. 1, and a second cavity portion communication channel 46*b*, which connects to the first cavity portion communication channel 46*a* and extends horizontally in both Figures. The second cavity portions 42 communicate through this cavity portion communication channel 46, which is a recess in the surface of the case 40 that faces the flow channel substrate 10.

In addition, the second cavity portion 42B fluidly communicates with the atmosphere exposure channel 44 via an atmosphere communication channel 18 (the dotted line area in FIG. 2) provided in the vibrating member 15. Specifically, the second cavity portion 42B connects to the atmosphere communication channel 18 from the end opposite the cavity portion communication channel 46. Through such a configuration, the cavity 60A fluidly communicates with the atmosphere exposure channel 44 only via the cavity 60B.

The atmosphere communication channel 18 includes a first atmosphere communication portion 18*a* that surrounds the atmosphere exposure channel 44, a second atmosphere communication portion 18*b* that connects to the first atmosphere communication portion 18*a* and that extends horizontally in FIGS. 1 and 2, and a third atmosphere communication portion 18*c* that connects to the second atmosphere communication portion 18*b* and connects to the first cavity portions 17. In the embodiment shown in FIG. 2, the atmosphere communication channel 18 is provided in the surface of the vibrating member 15 that faces the case 40, the top surface in FIG. 1.

Furthermore, the atmosphere exposure channel 44 passes through the case 40, and communicates with the atmosphere at the upper surface of the case 40.

As described above, the cavity 60B (the first cavity portion 17B and the second cavity portion 42B) fluidly communicates with the atmosphere exposure channel 44, and the cavity 60A (the first cavity portion 17A and the second cavity portion 42A) fluidly communicates with the atmosphere exposure channel 44 via the cavity 60B.

In some embodiments, the vibrating member 16 is made of a polyphenylene sulfide (PPS) film that is approximately several μm thick. Accordingly, water contained in the ink, that is held in the manifold 13 sometimes evaporates through the vibrating member 16. However, the evaporation of the water in the ink is prevented by the configuration of the atmosphere communication channel in the embodiments described herein.

With past configurations, cavity portions on the vibrating member 16 have communicated directly with the atmosphere exposure channel 44, and thus the cavity portions were constantly dried out, making it easier for water contained in the ink to pass through and evaporate. However, with the above-described configuration, the cavities 60 are kept more humid, and thus the evaporation of the water in the ink in the manifold 13 can be prevented.

As shown in FIGS. 3A and 3B, in this embodiment, when the ink components in the manifold 13A evaporate into the cavity 60A, some of the evaporated components are sent to the cavity 60B via the cavity portion communication channel 46 due to pressure changes in the manifold 13A. Furthermore, when the ink components in the manifold 13B evaporate into the cavity 60B, some of the evaporated components are sent to the atmosphere exposure channel 44 via the atmosphere communication channel 18 due to pressure changes in the manifold 13B.

As described above, the cavity 60A only communicates indirectly with the atmosphere communication channel 18, and thus is kept from drying out. This makes it more difficult for the water in the ink to evaporate. Meanwhile, the cavity 60B is configured so that air flows thereinto from the cavity 60A. In other words, comparatively moist air is supplied to the cavity 60B. Through this, drying can be kept to a minimum and the water in the ink can be prevented from evaporating.

According to the embodiments described above, the cavities 60 are kept comparatively humid, which prevents the water in the ink in the manifolds 13 from evaporation into cavities 60, and thus prevents a rise in the viscosity of the ink. Accordingly, exemplary ink jet recording heads 100 maintain favorable ejection properties over a long period of time, thus making it possible to carry out favorable printing.

Furthermore, a liquid source 90A may contain a liquid that evaporates easily, and be fluidly connected to the manifold 13A. A liquid source 90B may contain a liquid that does not evaporate as easily, and be fluidly connected to the manifold 13B. These liquids may be, for example, different colors of ink, which, as will be appreciated by those of ordinary skill in the art, may inherently have different evaporation characteristics. In other words, the more evaporative liquid is positioned upstream in the atmosphere exposure channel 44.

Second Embodiment

Figure 4:
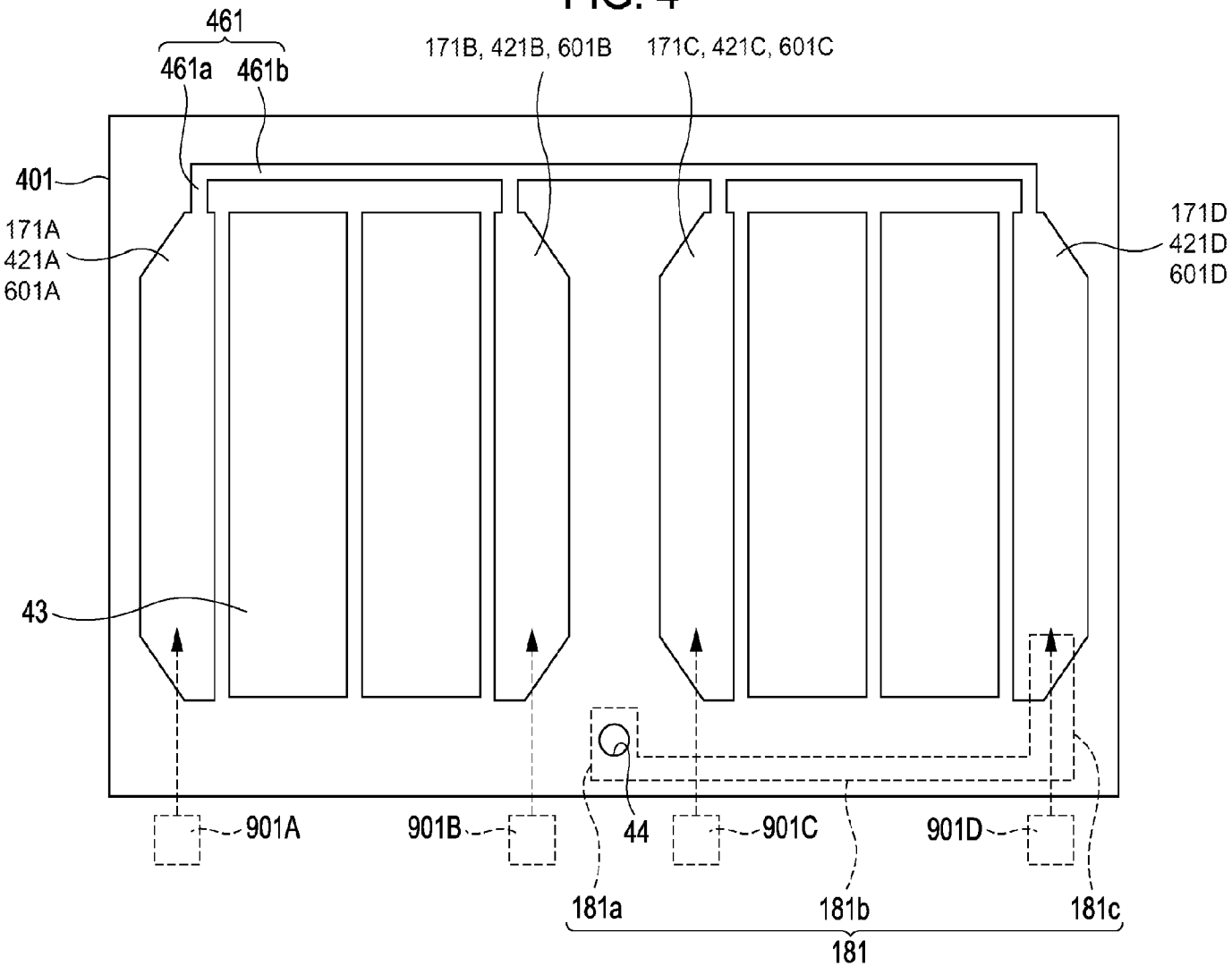
FIG. 4 is a bottom view of an ink jet recording head case, similar to FIG. 2, but according to a second exemplary embodiment of the invention.

FIG. 4 is a bottom view of a head case in a recording head according to a second exemplary embodiment. Elements that are structurally the same as those previously described will be given the same reference numerals, and redundant descriptions thereof will be omitted.

Although not shown in the drawings, the recording head 100 according to this embodiment includes four manifolds 13, and cavities 601 (601A, 601B, 601C, and 601D) are provided in regions corresponding to the respective manifolds 13. Each of the cavities 601 includes a first cavity portion 171 (first cavity portions 171A, 171B, 171C, and 171D) and a second cavity portion 421 (second cavity portions 421A, 421B, 421C, and 421D).

The second cavity portions 421 in a head case 401 communicate through a single cavity portion communication channel 461.

Meanwhile, the second cavity portion 421D communicates with the atmosphere exposure channel 44 via an atmosphere communication channel 181 (the dotted line area in FIG. 4) provided in the vibrating member 15.

As described above, the cavity 601D communicate with the atmosphere exposure channel 44. Furthermore, the cavities 601A, 601B, and 601C communicate with the atmosphere exposure channel 44 via the cavity 601D. The cavity portions communicate in parallel.

This configuration prevents the evaporation of water in the ink.

Specifically, the cavities 601A, 601B, and 601C communicate only indirectly with the atmosphere communication channel 181, and thus are kept humid. This makes it difficult for the water in the ink to evaporate. Meanwhile, the cavity 601D is configured so that air flows thereinto from the cavities 601A, 601B, and 601C. In other words, comparatively humid air is supplied to the cavity 601D, so drying is minimized.

According to the embodiments described above, the cavities 601 are kept comparatively humid, which prevents the water in the ink in the manifolds 13 from evaporation into cavities 601, and thus prevents a rise in the viscosity of the ink. Accordingly, exemplary ink jet recording heads 100 maintain favorable ejection properties over a long period of time, thus making it possible to carry out favorable printing.

Furthermore, because there is only one atmosphere exposure channel 44, the ink jet recording head 100 can be smaller than those of the prior art.

Furthermore, a liquid source 901A holding liquid that evaporates the most easily, a liquid source 901B holding liquid that evaporates the second most easily, a liquid source 901C holding liquid that evaporates the third most easily, and a liquid source 901D holding liquid that evaporates with the most difficulty can be respectively connected to manifolds 131A, 131B, 131C, 131D. In other words, the liquid that evaporates the most easily is the most upstream of the atmosphere exposure channel 44. For example, the liquid source 901A holds black ink, the liquid source 901B holds magenta ink, the liquid source 901C holds yellow ink, and the liquid source 901D holds cyan ink.

By connecting the liquid source 901 holding liquid that evaporates the most easily to the manifold 131 corresponding to the cavities 601 located upstream of the atmosphere exposure channel 44, it is possible to effectively prevent the evaporation of liquid components that easily evaporate.

Other Embodiments

Exemplary embodiments have been described in the foregoing, but the invention is not intended to be limited to the foregoing embodiments, including the structures, materials, and so on thereof.

Figure 5:
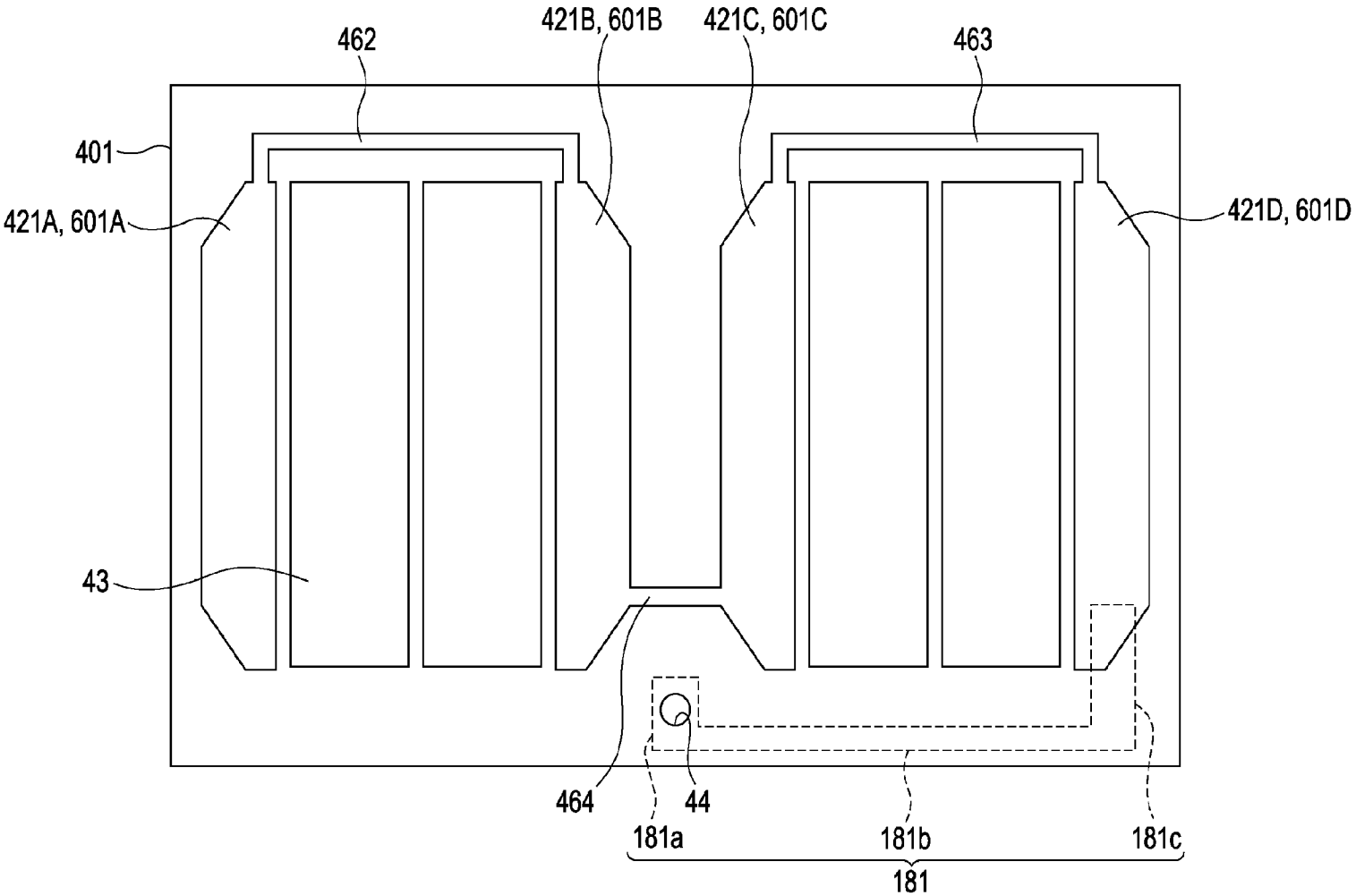
FIG. 5 is a bottom view of an ink jet recording head case according to a third exemplary embodiment of the invention.

For example, in the case where there are three or more manifolds 13, as shown in FIG. 5, multiple cavity portion communication channels may be provided. Note that portions that have the same effects as those in the embodiment of FIG. 4 will be given the same reference numerals, and redundant descriptions thereof will be omitted. As shown in FIG. 5, the second cavity portion 421A and the second cavity portion 421B communicate through a cavity portion communication channel 462. The second cavity portion 421C and the second cavity portion 421D communicate through a cavity portion communication channel 463. The end of the second cavity portion 421B on the opposite side of the cavity portion communication channel 462 and the end of the second cavity portion 421C on the opposite side of the cavity portion communication channel 463 communicate through a cavity portion communication channel 464. In FIG. 5, the cavities 601 communicate in series. The cavities 601 can be kept humid, minimizing evaporation of the water in the ink.

Figure 6:
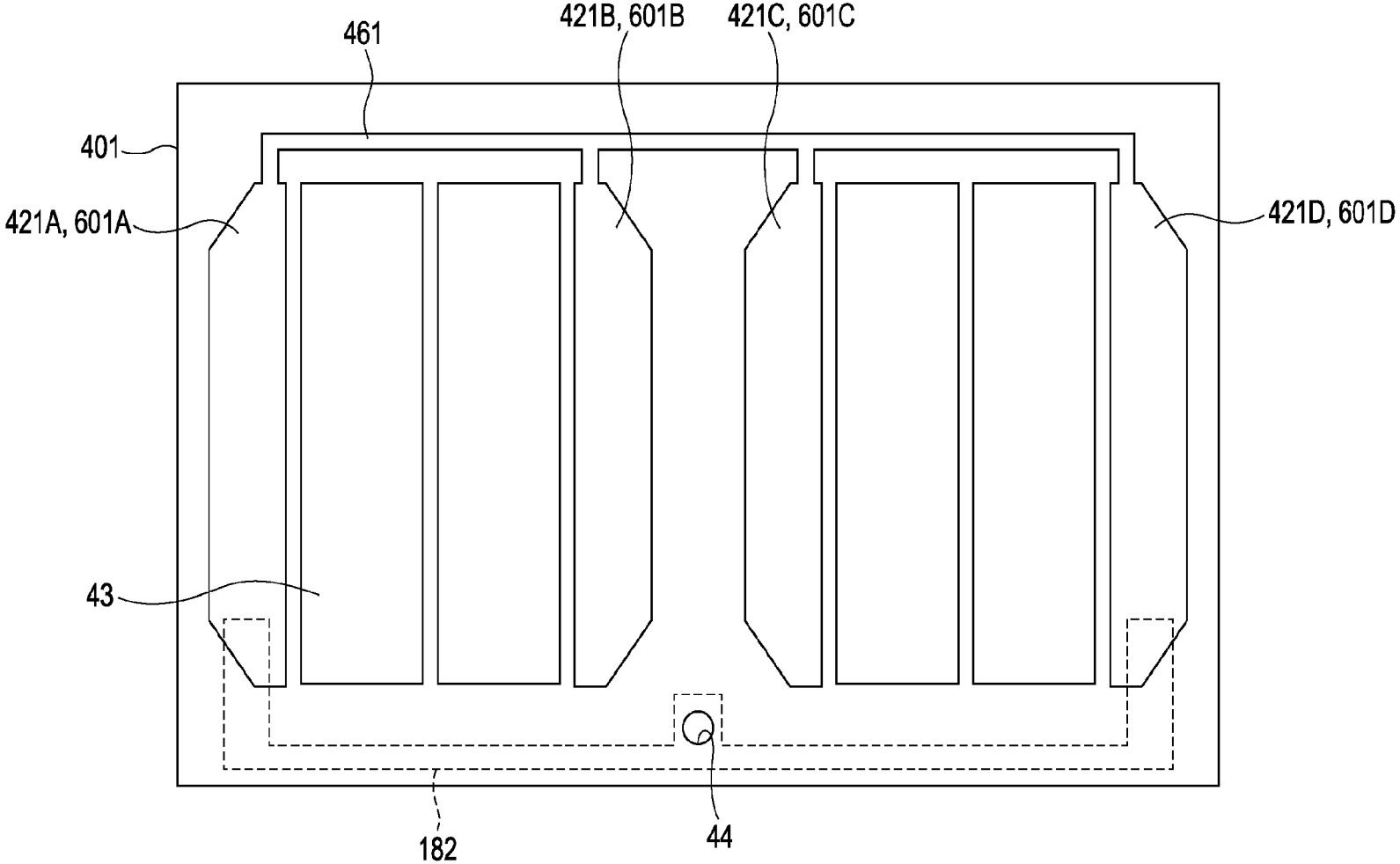
FIG. 6 is a bottom view of an ink jet recording head case according to a fourth exemplary embodiment of the invention.

In addition, the second cavity portion 421A and the second cavity portion 421D may each communicate with the atmosphere exposure channel 44 via an atmosphere communication channel 182, as shown in FIG. 6. In other words, the cavity 601B and the cavity 601C communicate with the atmosphere exposure channel 44 via the cavity 601A or the cavity 601D. The cavities 601 can be kept humid.

In addition, evaporation in the manifolds may be prevented even further by a winding atmosphere communication channel, or a narrower atmosphere communication channel.

Although liquid sources holding inks of differing colors have been described, the invention is not limited thereto, and, for example, the liquid sources may all hold ink of the same color.

Furthermore, although the cavity portion communication channels 46 and 461 have been described as on the surface of the case 40 that faces the flow channel substrate 10, the cavity portion communication channels 46 and 461 may, for example, be provided on the surface of the support plate 15*b* in the vibrating member 15 that faces the case 40. In other words, part of the support plate 15*b* may be removed, the first cavity portions 17 may communicate, and the concave portions may then be used as the cavity portion communication channels.

Although the atmosphere communication channels 18 and 181 have been described as in the surface of the vibrating member 15 that faces the case 40, the atmosphere communication channels 18 and 181 may, for example be provided in the surface of the case 40 that faces the flow channel substrate 10. In other words, part of the case 40 may be removed, the second cavity portions 42 may communicate, and the concave portions may then be used as the atmosphere communication channels.

Furthermore, although the second cavity portions 42 have been described as in regions corresponding to the first cavity portions 17 in the case 40, the second cavity portions 42 need not be provided in the regions corresponding to the case 40. In this case, the cavity portion communication channel may be provided in the vibrating member 15.

Although the flow channel substrate 10 has been described as serving as a manifold substrate, the flow channel substrate 10 and the manifold substrate may be separate entities.

Although the elastic membrane 15*a* and the vibrating member 16 have been described as a PPS film, these elements may instead be composed of another resin material such as polyethylene, or may be composed of a different kind of film material.

Furthermore, the disclosure above describes, as an example, a recording head having longitudinally-vibrating piezoelectric elements that extend and constrict in the axial direction. However, the invention is not intended to be limited thereto, and the same effects can be achieved with, for example, an ink jet recording head having thick film-type piezoelectric elements or a recording head having thin-film-type piezoelectric elements that include a piezoelectric material formed through the sol-gel method, the MOD method, sputtering, or the like.

Figure 7:
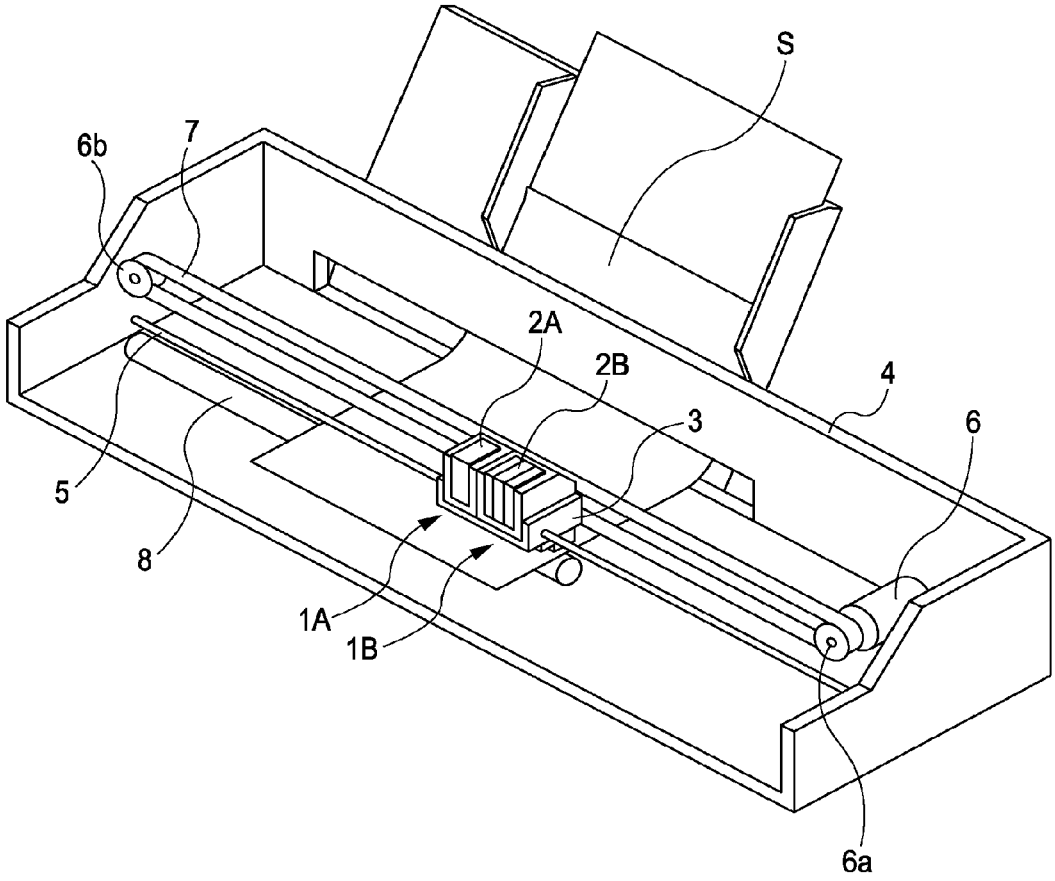
FIG. 7 is an isometric view of an ink jet recording apparatus according to an embodiment of the invention.

The ink jet recording heads according to the aforementioned embodiments constitute part of a recording head unit including an ink flow channel that communicates with an ink cartridge or the like, which is in turn installed in an ink jet recording apparatus. FIG. 7 is a perspective view illustrating an example of such an ink jet recording apparatus.

As shown in FIG. 7, ink cartridges 2A and 2B are mounted detachably in recording head units 1A and 1B that have ink jet recording heads. A carriage 3, in which these recording head units 1A and 1B are installed, moves freely in the axial direction of a carriage shaft 5 attached to an apparatus main body 4. These recording head units 1A and 1B each eject, for example, black ink compounds and color ink compounds.

In the case described above in which each manifold 131A-D is connected to a specific liquid source 901A-D, such as ink cartridges 901A-D with different colors of ink with different evaporative properties, the head unit 1A,1B may be configured for each manifold to be connected only to the proper ink cartridge 2A, 2B. For example, the head unit 1A, 1B may be shaped such that only a cartridge containing the appropriate color of ink will fit in each particular location, or may have visible markings to indicate to the user which color cartridge to insert at each location.

Driving force generated by a driving motor 6 is transmitted to the carriage 3 via multiple gears (not shown), and a timing belt 7 moves the carriage 3 along the carriage shaft 5. Meanwhile, a platen 8 is provided in the apparatus main body 4 along the same direction as the carriage shaft 5, and a recording sheet S, such as paper, supplied by paper supply rollers and the like (not shown), is wound upon and transported by the platen 8.

In the example shown in FIG. 7, the ink jet recording head units 1A and 1B each have a single ink jet recording head, but the invention is not particularly limited thereto; for example, each ink jet recording head unit 1A or 1B may include two or more ink jet recording heads.

Finally, although the aforementioned embodiments describe an ink jet recording head and an ink jet recording apparatus as examples of a liquid ejecting head and a liquid ejecting apparatus respectively, the invention applies to the entire range of liquid ejecting heads and liquid ejecting apparatuses, and can of course be applied in liquid ejecting heads that eject a liquid aside from ink and liquid ejecting apparatuses that includes such liquid ejecting heads. Various types of recording heads used in image recording apparatuses such as printers, coloring material ejecting heads used in the manufacture of color filters for liquid-crystal displays and the like, electrode material ejecting heads used in the formation of electrodes for organic EL displays, FEDs (field emission displays), and so on, bioorganic matter ejecting heads used in the manufacture of biochips, and so on can be given as other examples of liquid ejecting heads.

It should also be noted that the terms "fluid communication," "fluid connection," "fluidly communicating," and "fluidly connected" are used throughout the specification and claims to refer to both liquids and gases being capable of being exchanged. It should be appreciated that in the disclosed embodiments, liquid is exchanged between, for example, the liquid sources, the ink flow channels, the manifolds, the pressure generation chambers, the nozzles, and other liquid-containing elements. On the other hand, air is exchanged between, for example, the cavities, the cavity portion communication channel, the atmosphere exposure channel, and other air-containing elements. The term "fluid" should not be seen as limiting.

A recitation of "a", "an" or "the" is intended to mean "one or more" unless specifically indicated to the contrary.

The above description is illustrative and is not restrictive. Many variations of the disclosure will become apparent to those skilled in the art upon review of the disclosure. The scope of the disclosure should, therefore, be determined not with reference to the above description, but instead should be determined with reference to the pending claims along with their full scope or equivalents.

One or more features from any embodiment may be combined with one or more features of any other embodiment without departing from the scope of the disclosure.

All patents, patent applications, publications, and descriptions mentioned above are herein incorporated by reference in their entirety for all purposes. None is admitted to be prior art.

What is claimed is:

1. A liquid ejecting head comprising:

a nozzle plate with a plurality of nozzles defined therein;

a plurality of pressure generation chambers, each in fluid communication with one of the nozzles;

a manifold substrate comprising a plurality of manifolds, each configured to supply liquid to at least one of the pressure generation chambers;

a plurality of electric elements configured to change pressure of liquid within the pressure generation chambers to thereby eject the liquid via the nozzles;

a vibrating element configured to vibrate in response to pressure changes in the liquid within the manifolds;

a plurality of cavities provided on the vibrating element at positions that correspond to positions of the manifolds and disposed parallel to the nozzle plate, the plurality of cavities including a first cavity and a second cavity; and an atmosphere exposure channel that provides fluid communication between the first cavity and the atmosphere;

wherein at least the second cavity is in fluid communication with the atmosphere exposure channel via the first cavity.

2. The liquid ejecting head according to claim 1, further comprising a cavity portion communication channel which provides fluid communication between the first and the second cavities.

3. The liquid ejecting head according to claim 2, further comprising a head case, wherein the cavity portion communication channel is disposed in the head case.

4. The liquid ejecting head according to claim 2, wherein the cavity portion communication channel is disposed in the vibrating element.

5. The liquid ejecting head according to claim 1, further comprising a head case, wherein the atmosphere exposure channel is disposed in the head case.

6. The liquid ejecting head according to claim 1, wherein the atmosphere exposure channel is disposed in the vibrating element.

7. The liquid ejecting head according to claim 1, wherein the plurality of cavities comprises at least three cavities that are connected in series.

8. The liquid ejecting head according to claim 1, wherein the plurality of cavities comprises at least three cavities that are connected in parallel.

9. The liquid ejecting head according to claim 1, wherein the liquid ejecting head is an ink jet recording head.

10. The liquid ejecting head according to claim 1, wherein the liquid ejecting head is a color material ejecting head configured to be used in the manufacture of color filters for liquid-crystal displays.

11. A liquid ejecting head unit, configured to be mounted in a liquid ejecting apparatus, comprising:

a liquid ejecting head, comprising:

a nozzle plate with a plurality of nozzles defined therein;

a plurality of pressure generation chambers, each in fluid communication with one of the nozzles;

a manifold substrate comprising a plurality of manifolds, each configured to supply liquid to at least one of the pressure generation chambers;

a plurality of electric elements configured to change pressure of liquid within the pressure generation chambers to thereby eject the liquid via the nozzles;

a vibrating element configured to vibrate in response to pressure changes in the liquid within the manifolds;

a plurality of cavities provided on the vibrating element at positions that correspond to positions of the manifolds and disposed parallel to the nozzle plate, the plurality of cavities including a first cavity and a second cavity; and an atmosphere exposure channel that provides fluid communication between the first cavity and the atmosphere;

wherein at least the second cavity is in fluid communication with the atmosphere exposure channel via the first cavity;

the liquid ejecting head unit further comprising a plurality of ink flow channels configured to provide fluid communication between the manifolds and a plurality of liquid sources.

12. The liquid ejecting head unit of claim 11, further configured such that each manifold can only be connected to a specific, corresponding one of the liquid sources.

13. The liquid ejecting head unit of claim 12, wherein a manifold that corresponds to a cavity that is the farthest upstream from the atmosphere exposure channel is connected to a liquid source containing a liquid having a faster evaporation rate than the evaporation rates of liquids in the other liquid sources.

14. A liquid ejecting head comprising:

a nozzle plate with a plurality of nozzles defined therein;

a plurality of pressure generation chambers, each in fluid communication with one of the nozzles and configured to provide liquid to the nozzle;

a manifold substrate comprising a plurality of manifolds, each configured to supply liquid to at least one of the pressure generation chambers;

a plurality of electric elements configured to change pressure of liquid within the pressure generation chambers to thereby eject the liquid via the nozzles;

a vibrating element configured to vibrate in response to pressure changes in the liquid within the manifolds;

a plurality of cavities provided on the vibrating element at positions that correspond to positions of the manifolds and disposed parallel to the nozzle plate, the plurality of cavities including a first cavity and a second cavity; and an atmosphere exposure channel that provides fluid communication between the first cavity and the atmosphere, configured such that air can flow between the first cavity and the atmosphere;

wherein at least the second cavity is in fluid communication with the atmosphere exposure channel via the first cavity, such that air can flow between the first and second cavities.

15. The liquid ejecting head according to claim 14, further comprising a cavity portion communication channel which provides fluid communication between the first and the second cavities, such that air can flow between the first and second cavities.

16. The liquid ejecting head according to claim 15, further comprising a head case, wherein the cavity portion communication channel is disposed in the head case.

17. The liquid ejecting head according to claim 15, wherein the cavity portion communication channel is disposed in the vibrating element.

18. The liquid ejecting head according to claim 14, further comprising a head case, wherein the atmosphere exposure channel is disposed in the head case.

19. The liquid ejecting head according to claim 14, wherein the atmosphere exposure channel is disposed in the vibrating element.

20. The liquid ejecting head according to claim 14, wherein the plurality of cavities comprises at least three cavities that are connected in series.

21. The liquid ejecting head according to claim 14, wherein the plurality of cavities comprises at least three cavities that are connected in parallel.

* * * * *